United States Patent [19]

Curtis

[11] 4,351,224

[45] Sep. 28, 1982

[54] BIPOD MECHANISM FOR SMALL ARMS

[75] Inventor: George F. Curtis, Sanford, Me.

[73] Assignee: Maremont Corporation, Carol Stream, Ill.

[21] Appl. No.: 137,780

[22] Filed: Apr. 7, 1980

[51] Int. Cl.[3] ..... F41C 29/00

[52] U.S. Cl. ..... 89/37 BA

[58] Field of Search ..... 42/94; 89/37 BA, 40 E

[56] References Cited

U.S. PATENT DOCUMENTS

| | | | |
|---|---|---|---|
| 1,372,599 | 3/1921 | Butler | 89/40 E |
| 2,807,904 | 10/1957 | Kreske | 42/94 |
| 3,235,997 | 2/1966 | Stoner | 42/94 |
| 3,999,461 | 12/1976 | Johnson et al. | 42/94 |

FOREIGN PATENT DOCUMENTS

| | | | |
|---|---|---|---|
| 25122 | 3/1906 | Austria | 42/94 |
| 171768 | 6/1906 | Fed. Rep. of Germany | 42/94 |
| 567588 | 3/1924 | France | 42/94 |

*Primary Examiner*—Stephen C. Bentley

*Attorney, Agent, or Firm*—Allegretti, Newitt, Witcoff & McAndrews, Ltd.

[57] ABSTRACT

A bipod mechanism for a light weight machine gun comprising a pair of individually telescopically adjustable leg assemblies and a mounting structure connectable in supporting relation with the gun mounting the pair of leg assemblies for movement between a folded transport position wherein the leg assemblies extend generally parallel alongside the longitudinal extent of the gun and a gun supporting and firing position wherein the leg assemblies extend downwardly in outwardly converging relation with respect to the longitudinal extent of the gun. Each of the leg assemblies includes an inner leg member of generally L-shaped cross-sectional configuration and an outer leg member of generally L-shaped cross-sectional configuration mounted in generally nested relation therewith. Pins sliding in slots provide for relative longitudinally sliding movement between the inner and outer members while in nested relation. The movements provided are controlled by resilient locking assemblies which enable the leg assemblies to be yieldingly moved from their transport position into a firing position where they are automatically locked and the outer leg member of each leg assembly to be yieldingly moved into any one of a plurality of extended positions where automatic locking occurs.

11 Claims, 14 Drawing Figures

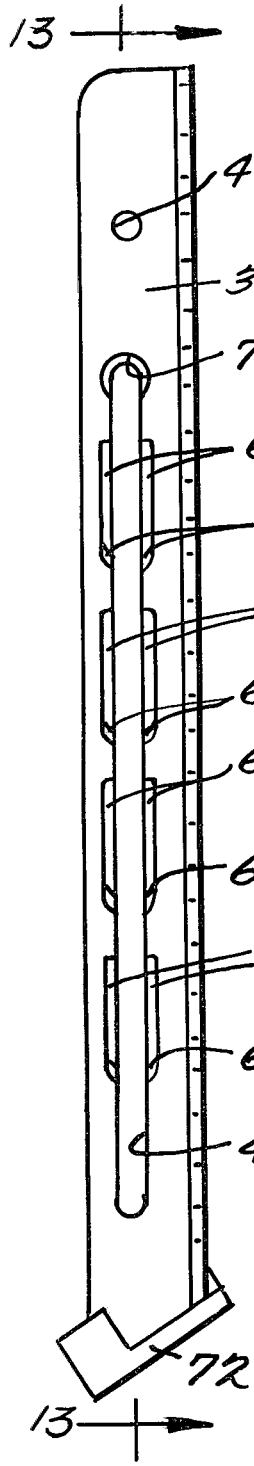
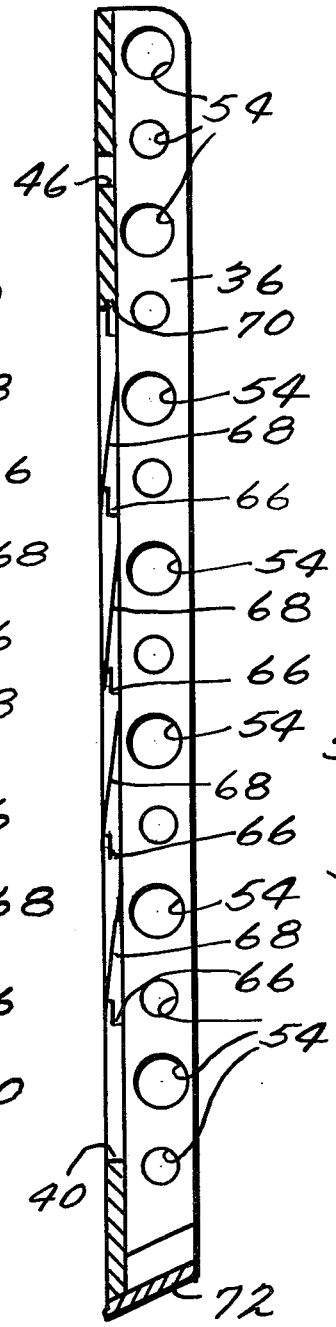
Fig. 13.
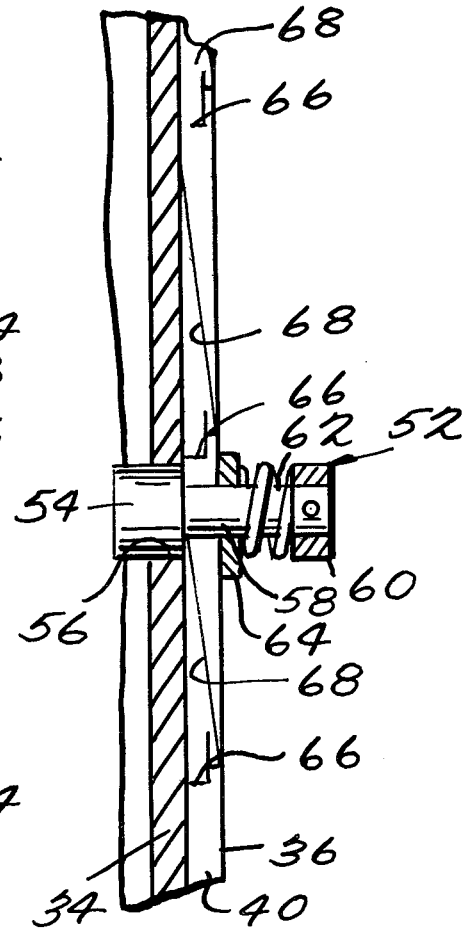
Fig. 14.
Fig. 12.

BIPOD MECHANISM FOR SMALL ARMS

This invention relates to gun mounts and more particularly to bipods of the type providing grounded support for small arms weapons during firing.

The bipod mechanism of the present invention is particularly adapted to be mounted on a machine gun such as an M60 so as to be carried therewith. The bipod mechanism is of the folding type being movable between a firing position and a folded transport position. The bipod mechanism includes the usual pair of telescopic leg assemblies enabling the support of the gun in the firing position to be established at different vertical levels above the ground. A typical bipod mechanism of this general type is disclosed in U.S. Pat. No. 2,807,904. Certain principles embodied in the present invention also have applicability to snap-on type bipod mechanisms, one example of which is disclosed in U.S. Pat. No. 3,235,997.

A basic requirement of a bipod mechanism used with small arms weaponry is that it must be of minimum weight and yet have sufficient strength and structural integrity as to be effective in operation over an extended period of rough usage without malfunction. Moreover, it is important that the telescopic adjustment of the leg assemblies be accomplished in a simple and convenient manner. With respect to foldable type bipod mechanisms, it is also important that the leg assemblies be capable of simple and convenient movement from the transport position into the firing position.

It is an object of the present invention to provide a bipod mechanism of the type described which is capable of meeting these desirable criteria. In accordance with the principles of the present invention this objective is obtained by providing in a bipod mechanism of the type described improved telescopic leg assemblies, each of which includes an inner leg member of generally L-shaped cross-sectional configuration and an outer leg member of generally L-shaped cross-sectional configuration mounted in nested relation with respect to the inner leg member, the telescopic movement between the leg members being accomplished by pin and slot connections. The cross-sectional configuration provides optimum strength with minimal weight while the slots of the pin and slot connections further effect a desired weight reduction without materially effecting the strength characteristics.

Preferably, means is provided for resiliently retaining the pair of leg members associated with each leg assembly in a fully retracted or transport position wherein the leg members are substantially longitudinally coextensive while permitting yielding movement therefrom in a direction toward a fully extended position in response to the application of a moving force to one of the leg members and for lockingly retaining the members in such fully extended position while preventing movement therefrom toward the transport position in response to the application of a moving force to the one leg member without first unlocking the aforesaid locking retention. With this arrangement movement of the leg assemblies from their fully retracted position into their fully extended position can be simply accomplished by manually gripping the movable leg member of each leg assembly and applying a moving force thereto sufficient to overcome the resilient bias. As each leg is moved into its fully extended position it is automatically locked into that position so that it cannot be inadvertently moved out of such position by the application of a moving force without first unlocking the securement provided. Thus, the leg assemblies are capable of simple extension into a desired firing position and once in such position they are lockingly retained therein until manually unlocked.

Preferably, means is also provided for lockingly retaining the leg members of each leg assembly in a plurality of intermediate positions between the aforesaid fully extended and fully retracted positions while preventing movement therefrom in a direction toward the fully retracted position in response to the application of a moving force to the one leg member without first unlocking the aforesaid locking retention and while permitting yielding movement in a direction toward the fully extended position in response to the application of a moving force to the one leg member. With this arrangement the operator has the ability to move the leg assemblies into any desired extended position by the simple application of a moving force to one of the leg members of each leg assembly. The leg assemblies are lockingly retained in such position and must be unlocked before they can be moved back into their fully retracted position.

Where the bipod mechanism is of the permanently mounted type movable between a firing position and a folded transport position it is likewise preferable to provide means for resiliently retaining the leg assemblies in their folded transport position so that they can be yieldingly moved therefrom by the simple application of a moving force. When the leg assemblies are moved into their firing position they are automatically lockingly retained therein so that they are prevented from being moved therefrom in a direction toward the transport position in response to the application of a moving force thereto until an unlocking operation has been accomplished. Here again this arrangement provides the operator with the capability of simple and convenient movement of the leg assemblies from their folded position into their firing position while at the same time insuring against unwanted movement of the leg assemblies out of the firing position when moved therein. The movement of the leg assemblies from the firing position is relatively simple, however, after the unlocking operation has been accomplished.

Accordingly, it is an object of the present invention to provide a bipod mechanism of the type described which is simple in construction, effective in operation and economical to manufacture.

These and other objects of the present invention will become more apparent during the course of the following detailed description and appended claims.

The invention may best be understood with reference to the accompanying drawings, wherein an illustrative embodiment is shown.

In the drawings:

FIG. 12 is an elevational view of the left outer leg member;

FIG. 13 is a sectional view taken along the line 13—13 of FIG. 12; and

FIG. 14 is a view similar to FIG. 4 showing the locking member in its unlocked position.

Figure 1:
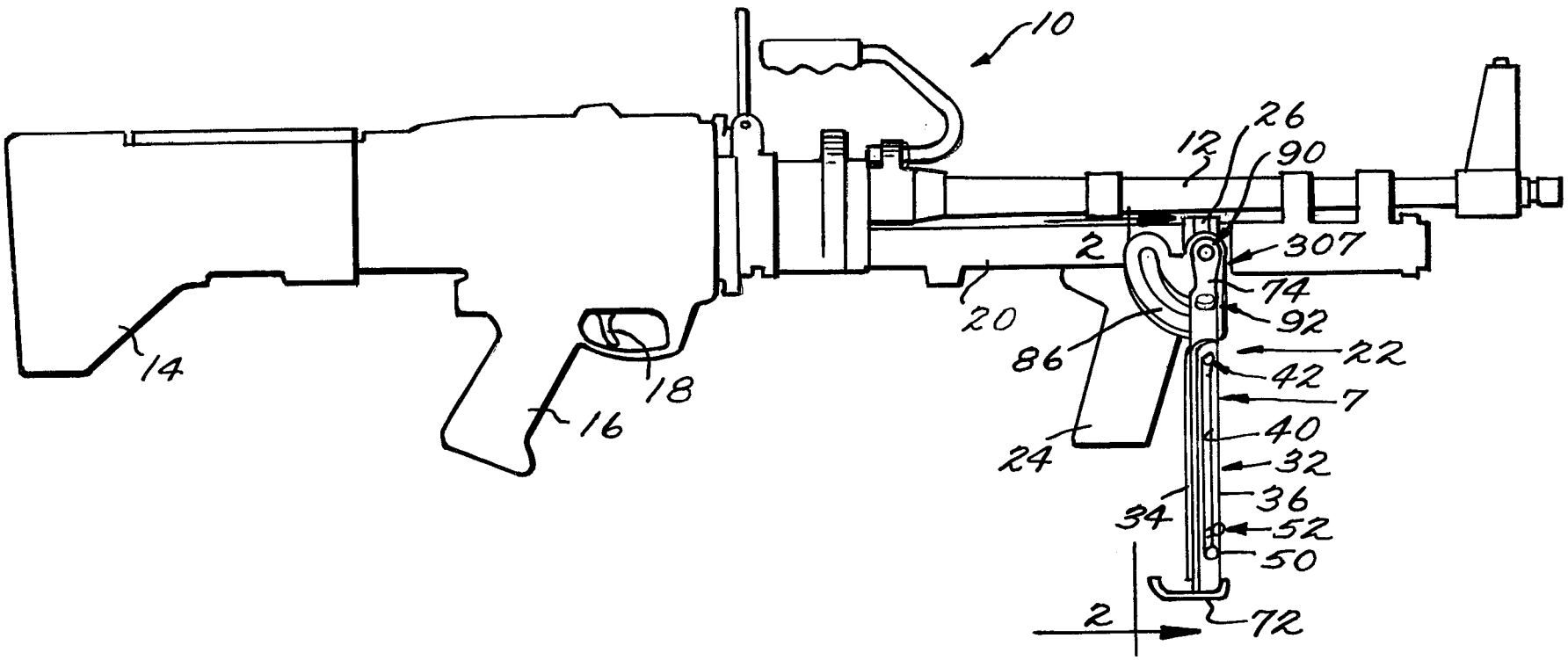
FIG. 1 is a side elevational view of an M60 machine gun illustrating the bipod mechanism of the present invention mounted thereon in its firing position.

Referring now more particularly to the drawings, there is shown therein an exemplary small arms weapon, generally indicated at 10, which is illustrated in outline to represent a known lightweight machine gun, specifically the M60. The weapon 10 includes the usual components such as a barrel 12, a tail stock 14, a grip 16 and a trigger 18. The arrangement shown also includes a receiving tube 20 which is positioned below a barrel on which a bipod mechanism, generally indicated at 22, embodying the principles of the present invention is adapted to be permanently mounted. As best shown in FIG. 1, the mounting is effected by means of a hand grip section 24 provided with a ring member 26 arranged to be suitably secured to the receiving tube as by a clamping bolt 28 (see FIG. 8).

The bipod mechanism 22 includes a mounting structure, generally indicated at 30, which is adapted to cooperate both with the clamp member 26 and the receiving tube 20. The mounting structure 30 serves to mount a pair of telescopically adjustable leg assemblies, generally indicated at 32, for movement between a folded transport position (FIG. 9) wherein the leg assemblies extend generally parallel alongside the longitudinal extent of the gun and a gun supporting and firing position, as shown in FIG. 1, wherein the leg assemblies extend downwardly in outwardly converging relation with respect to the longitudinal extent of the gun.

Figure 2:
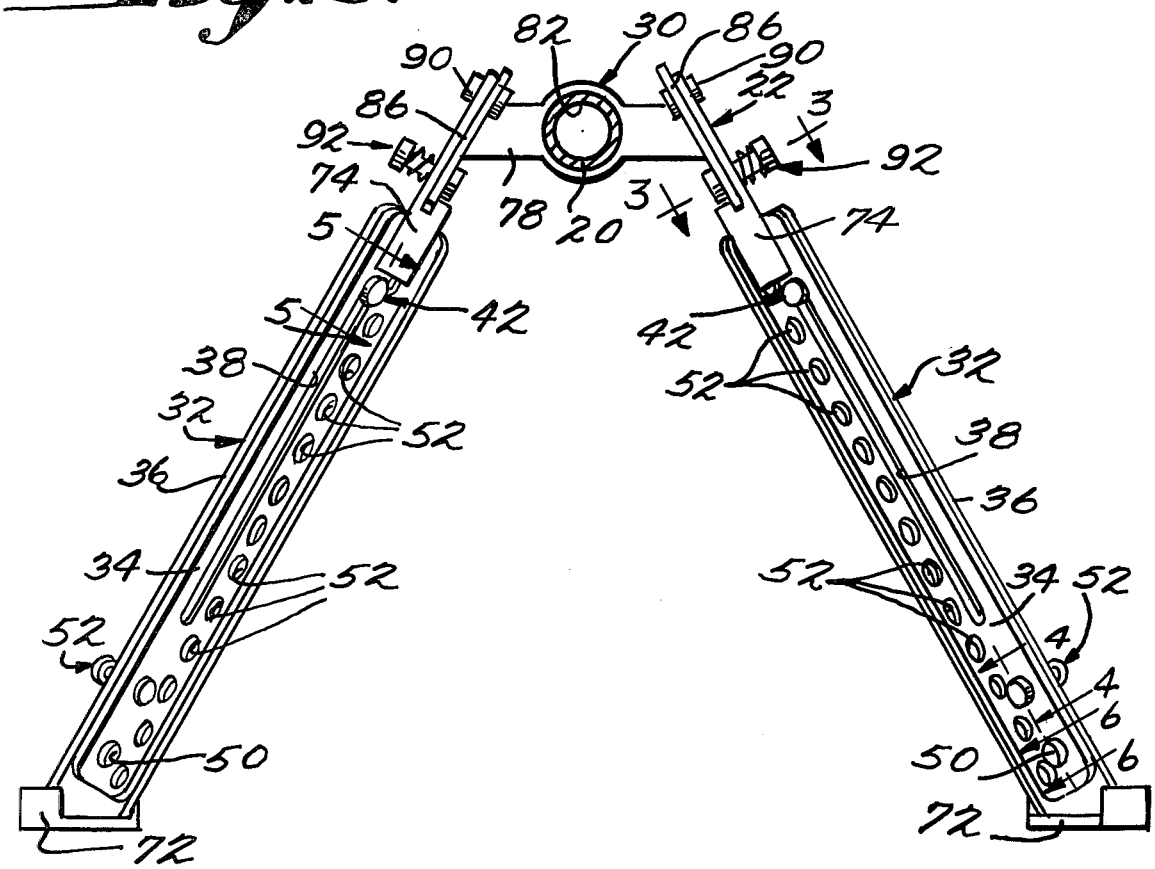
FIG. 2 is an enlarged fragmentary cross-sectional view taken along line 2—2 of FIG. 1.
Figure 5:
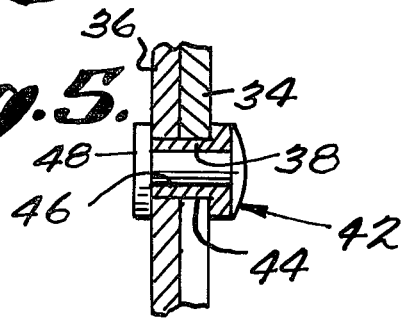
FIG. 5 is an enlarged fragmentary sectional view taken along the line 5—5 of FIG. 2.
Figure 6:
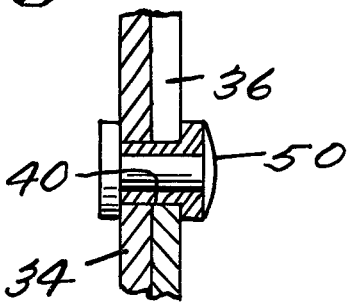
FIG. 6 is an enlarged fragmentary sectional view taken along the line 6—6 of FIG. 2.

As best shown in FIGS. 2, 7, 8 and 9, each of the leg assemblies 32 is of substantially identical construction and consequently a description of one will suffice to provide an understanding of the structure and operation of both. Preferably, each leg assembly 32 is formed essentially of an inner leg member 34 which has an essentially L-shaped cross-sectional configuration and an outer leg member 36 which has a similar L-shaped cross-sectional configuration and is disposed in generally nested relation with respect to the inner leg member 34. Each pair of inner and outer leg members 34 and 36 is mounted for relative longitudinal movement with respect to each other between a fully retracted limiting position, as shown in FIGS. 1 and 2, wherein the members are generally longitudinally coextensive and a fully extended limiting position by means of pin and slot connections which include a longitudinally extending slot 38 in the inner leg member and a longitudinally extending slot 40 in the outer leg member. A headed pin assembly, generally indicated at 42, extends through the elongated slot 38 in the inner leg member and is fixedly secured to the other outer leg member. As best shown in FIG. 5, the pin assembly includes a flanged bushing 44 which extends through the slot 38 and into an opening 46 in the outer leg member 36. A rivet 48 extends through the bushing and is deformed over the flange of the bushing to complete the pin connection. It will be understood that a similar pin assembly 50 extends through the opening 40 in the outer leg member 36 and is secured to the inner leg member. The heads of the pins serve to retain the inner and outer leg members in nested relation while the engagement of the pins within the slots permits relative longitudinal movement between the leg members while the leg members are retained in nested relation.

It will be noted that each inner leg member 34 is formed with a series of longitudinally spaced openings 52 which are of a size and number sufficient to lighten the weight of the inner leg member without materially sacrificing the strength thereof. Similarly, each outer leg member 36 is provided with a multiplicity of longitudinally spaced openings 54 which likewise serve to reduce the weight of the leg members without materially sacrificing strength.

Each leg assembly is provided with means for releasably retaining the same in the fully extended and fully retracted positions thereof as well as a plurality of intermediate positions therebetween. As best shown in FIGS. 4 and 12–14, the releasable means includes a locking assembly, generally indicated at 52, associated with each leg assembly 32. Each locking assembly 52 consists essentially of a locking member including a cylindrical locking portion 54 which is mounted for sliding movement within a cylindrical opening 56 formed in the lower end portion of the associated inner leg member 34 at a position spaced upwardly from the associated pin 50. The locking portion 54 and opening 56 have a transverse dimension which is greater than the associated slot 40. The locking assembly 52 also includes a central pin portion 58 of reduced diameter with respect to the enlarged locking portion 54. The central pin portion 58 is of a size slightly smaller than the associated slot 40 and extends therethrough. A washer or collar 60 is pinned to the outer extremity of the pin portion 58 and a coil spring 62 is disposed in surrounding relation to the intermediate pin portion 58. The outer end of the spring 62 engages the associated collar 60 while the inner end engages a washer 64 which slidably contacts the associated outer surface of the outer leg member 36 along the slot 40. The spring 62 thus serves to resiliently bias the locking portion 54 through the opening 56 in a direction toward the nested inner surface of the associated outer member 36.

Formed in the marginal inner portions of the outer member 36 extending along the slot 40 is a multiplicity of longitudinally spaced recesses which include longitudinally spaced locking surfaces 66 and inclined cam surfaces 68. It can be seen that when the outer member 36 of each leg assembly 32 is disposed within its fully retracted position with respect to the associated inner member 34, locking portion 54 will be disposed in the lowermost recess in engagement with the lowermost locking surface 66. The interengagement of the locking surface 66 with the locking portion 54 serves to prevent further retracted or upward movement of the outer leg member 36 with respect to the associated inner leg member 34. However, it will be noted that the application of a moving force to the outer member 36 in a downward direction will result in a relative downward longitudinal movement of the outer member with respect to the associated inner member 34, the cam surface 68 serving to yieldingly move the locking member portion 54 against the resilient bias of spring 62 in an outward direction. It will be understood that continued application of moving force on the outer leg member 36 will serve to bring the next lowest locking surface 66 in a position to receive the locking portion 54. When the outer leg member reaches this position the locking member portion 54 will be biased by the spring 62 inwardly. However, this inward movement of the locking member portion 54 does not lock the outer member against further movement since the next cam surface 68 will serve to yieldingly move the locking member portion outwardly as before.

In this way, the outer leg member of each leg assembly is capable of movement in response to the application of a moving force thereto from a fully retracted position into a fully extended position. In this regard, it will be noted that a locking surface 70 is formed adjacent the upper end of the associated slot 40 for the purpose of preventing further movement beyond the fully extended position. Since the locking surface 70 does not have a cam surface associated with it once the outer leg member has been moved into its fully extended position and the locking portion 54 is allowed to be spring biased into engagement with the locking surface 70, the associated outer member 36 is lockingly retained from movement out of its fully extended position in response to the application of a moving force thereto until the locking retention is released or unlocked. Such release or unlocking movement consists of a manual engagement of the collar 60 in a direction to move the locking portion 54 outwardly so that the inner end thereof is moved out of engagement with the locking surface 70. After this unlocking movement takes place the application of a moving force to the outer leg in a direction toward the fully retracted position will result in a movement toward that position so long as the locking assembly 52 is manually maintained in its unlocked position. If, during the movement of the outer leg member 36 by virtue of the application of a moving force thereto the locking member portion 54 is released, as for example in the position shown in FIG. 14, further movement of the outer member 36 toward its fully retracted position will result in the locking portion 54 riding inwardly along the cam surface 68 until the associated locking surface 66 thereof is engaged.

Thus, it can be seen that the three longitudinally spaced locking surfaces 66 between the lowermost locking surface 66 and the other limiting locking surface 70 will each serve to retain the outer leg member of the associated leg assembly in an intermediate position. In any intermediate position the outer leg member 36 is capable of yielding movement in a direction toward its fully extended position in response to the application of a moving force in that direction but is lockingly retained against movement toward the fully retracted position in response to the application of a moving force in that direction until the locking assembly is manually engaged as aforesaid.

Each leg assembly 32 also includes a foot member 72 which is rigidly mounted, as by welding or the like, on the lower end of the associated outer leg member 36 and a mounting member 74 rigidly secured to the upper inner end of the associated inner leg member 34. Each mounting member 74 forms a part of the mounting structure 30.

Figures 7, 9:
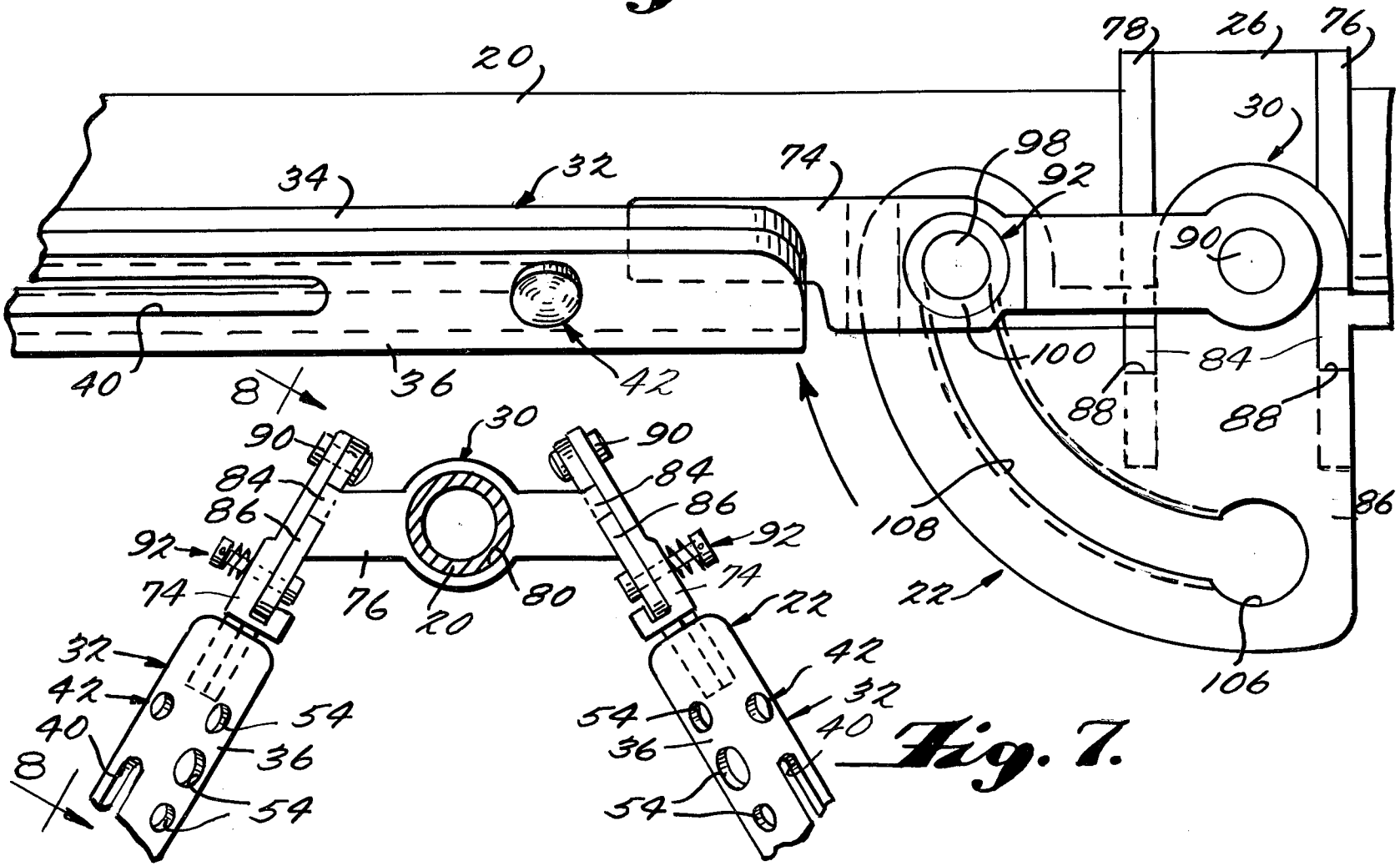
FIG. 7 is an enlarged fragmentary sectional view taken along the line 7—7 of FIG. 1.
FIG. 9 is a view similar to FIG. 8 showing the leg assembly of the bipod mechanism in its transport position.
Figures 8, 10, 11:
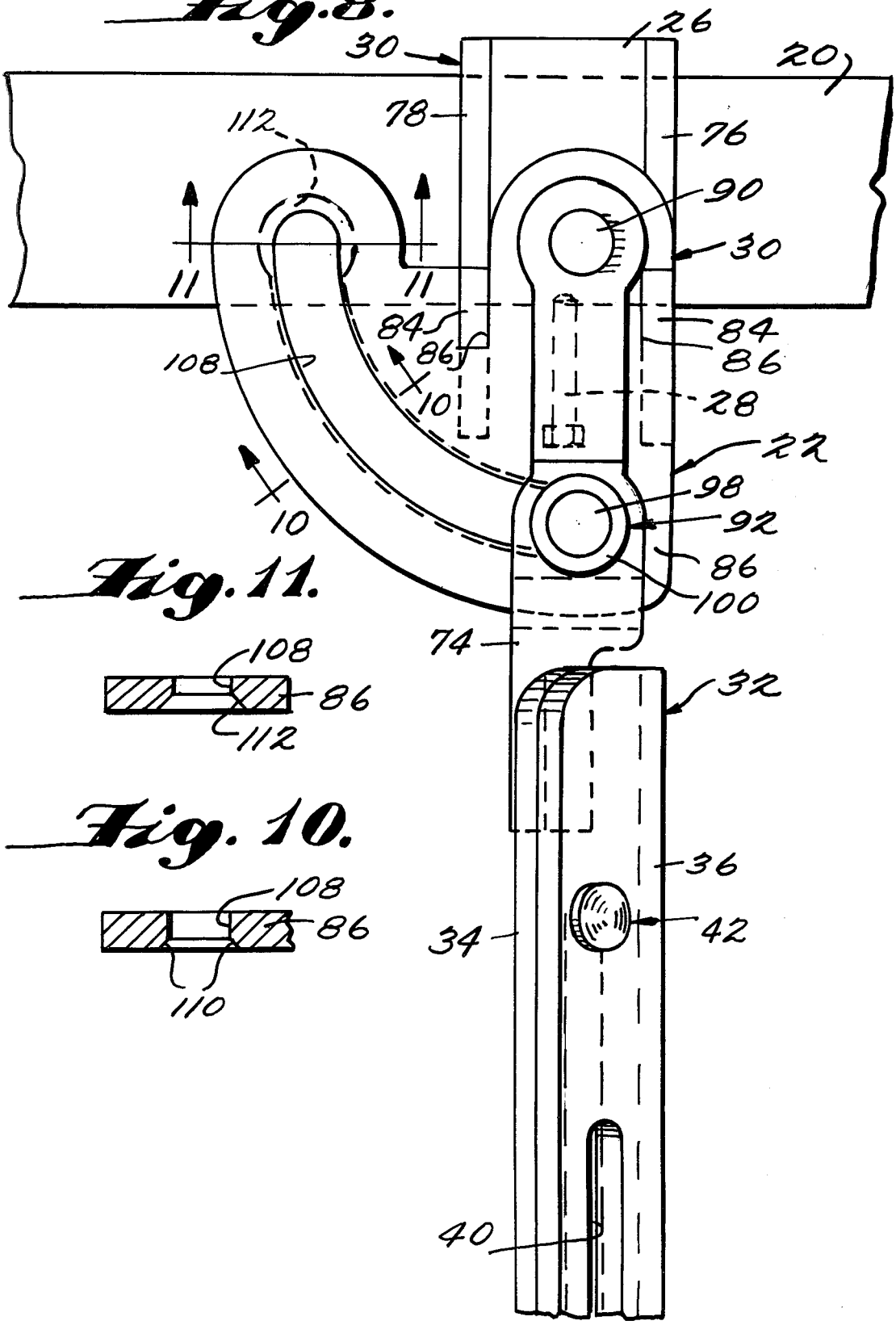
FIG. 8 is an enlarged fragmentary elevational view viewed along the line 8—8 of FIG. 7.
FIG. 10 is an enlarged fragmentary sectional view taken along the line 10—10 of FIG. 8.
FIG. 11 is an enlarged fragmentary sectional view taken along the line 11—11 of FIG. 8.

The mounting structure 30 also includes forward and rearward mounting plates 76 and 78 of generally similar construction adapted to be mounted on opposite sides of the clamp member 26. As shown in FIG. 7, the forward plate 76 is formed with a central opening 80 through which the receiving tube 20 extends. As shown in FIG. 8, the rearward mounting plate 78 is formed with a similar opening 82 for receiving the receiving tube 20. Each of the plates 76 and 78 is provided with a pair of oppositely outwardly directed mounting tabs 84. The tabs 84 serve to position a pair of inclined segmental mounting plates 86 in oppositely inclined positions on opposite sides of the receiving tube 20. Each inclined mounting plate 86 includes tab receiving openings 88 within which the associated tabs 84 are engaged, the interengagement being fixedly secured, as by welding or the like. As best shown in FIGS. 2 and 7, the inclined segmental plates 86 are disposed at an angle of approximately 30° with respect to a median vertical plane passing through the axis of the receiving tube 20 so that an angle of 60° is defined by the two inclined plates.

The mounting member 74 fixed to the upper inner end of the associated inner leg member 34 of each leg assembly 32 is pivotally connected with the associated mounting plate 86, as by a pivot pin assembly 90, providing a pivotal axis for the associated leg member which extends substantially at right angles to the inclination of the associated plate 86. The pivotal axes provided by both pivot pin assemblies 90 are disposed at an angle with respect to one another and intersect at a point contained within the adjacent median vertical plane. The angle defined between the axes is approximately 120°.

Figure 3:
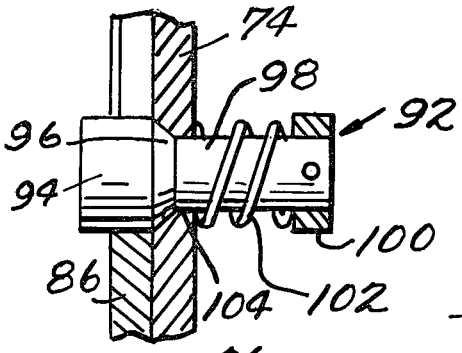
FIG. 3 is an enlarged fragmentary sectional view taken along the line 3—3 of FIG. 2.
Figure 4:
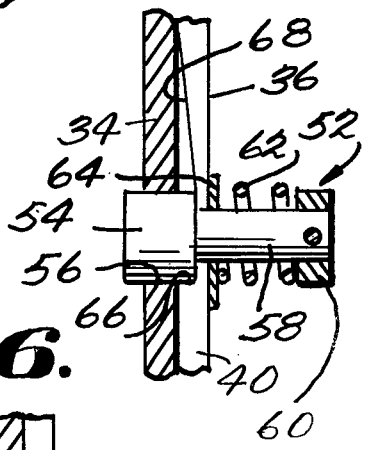
FIG. 4 is an enlarged fragmentary sectional view taken along the line 4—4 of FIG. 2.

Each pivot pin 90 extends through the upwardly extending end of the associated mounting member 74. A locking assembly 92 is mounted within each mounting member 74 at a position intermediate the ends thereof. As best shown in FIG. 3, each locking assembly 92 is generally similar to the locking assembly 52 and includes a generally cylindrical locking portion 94 having a frustoconical portion 96 extending from the inner end thereof to an intermediate pin portion 98. The outer end of the pin portion 98 has a collar 100 pinned thereto and a coil spring 102 surrounds the pin portion 98. One end of the coil spring 102 engages the collar 100 while the other end engages the adjacent portion of the associated member 74 which surrounds a countersunk opening 104 therein within which the locking assembly 92 is slidably mounted.

The cylindrical locking portion 94 of each locking assembly 92 is adapted to be engaged within a cylindrical opening 106 formed in the associated plate 86 when the associated leg assembly 32 is in its firing position. Each segmental plate also includes an arcuate slot 108 which communicates at one end with the associated opening 106. Each slot 108 is of a width less than the diameter size of the opening 106, the dimension being such as to receive the reduced intermediate pin portion 98 of the locking assembly therethrough. The surface of each plate 86 disposed outwardly with respect to the side thereof on which the associated mounting member 74 pivots is formed with relatively shallow angularly inclined surfaces 110. The inclination of the surfaces 110 is such as to accommodate the frustoconical portion 96 of the associated locking assembly 92. The inclined surfaces 110 extend into the opening 106 at one end of the slot 108 and merge with a frustoconical recess 112 at the opposite end of the slot. As best shown in FIG. 11, the recess 112 extends inwardly from the outer surface of the plane 86 to a depth substantially greater than the inclined surfaces 110.

It will be understood that so long as each locking assembly 92 is disposed in the position shown in FIGS. 3 and 8 wherein the locking portion 94 is disposed within the opening 106 the associated leg assembly will be lockingly retained in its firing position against movement therefrom in response to the application of a moving force thereon until the locking assembly 92 is moved into an unlocking or releasing position. This movement is similar to the movement of the locking assembly 52 previously described and consists essentially of a manual engagement of the collar 100 so as to move the locking portion 94 outwardly until the frustoconical portion 96 is disposed outwardly of the inclined surfaces 110. With the locking assembly 92 in this position the application of the moving force on the associated leg assembly 32 will serve to pivot the associated leg assembly about the pivotal axis provided by the associated pivot pin assembly 90 in a direction toward the transport position. The locking assembly 92 can be immediately released after an initial portion of this movement takes place, in which case the spring 92 will serve to move the frustoconical portion 96 of the locking assembly into engagement with the surfaces 110. While this engagement will resiliently restrain movement, a continued application of the moving force will effect yielding movement until the end of the slot 108 is reached, at which position the spring 102 will serve to resiliently urge the frustoconical portion 96 inwardly into engagement of the recess 112. The associated leg assembly 32 is then in its transport position as shown in FIG. 9 and is resiliently retained therein.

The interengagement of the frustoconical portion 96 of each locking mechanism 92 within the associated recess 112 is such that the associated leg assembly can be yieldingly moved out of its transport position toward and into its firing position in response to the application of a moving force to the associated leg assembly, the cam action between the frustoconical portion 96 and frustoconical recess 112 accommodating such yielding movement. However, in response to the movement of the associated leg assembly 32 into its firing position, the spring 102 of the associated locking assembly 92 will bias the cylindrical locking portion 94 fully into engaged relation within the opening 106, thus lockingly retaining the associated leg member 32 therein.

In operation, the bipod mechanism 22 is normally carried with the machine gun 10 with its leg assemblies 32 resiliently retained in their transport position, as shown in FIG. 9. In this position the leg assemblies extend in generally parallel relation along opposite sides of the longitudinal extent of the gun 10. When it is desired to utilize the bipod mechanism 22 to support the gun 10 for operative firing, each of the leg assemblies 32 is moved from its transport position into its firing position, as shown in FIGS. 1, 2, 7 and 8. This movement is accomplished by simply applying a moving force to the leg assemblies and the associated locking assemblies 92 will permit yielding movement of the leg assemblies from their transport positions and lockingly retain the same in their firing position, in response to their movement into such position. In the event the desired vertical position of support of the gun is greater than the extent of the leg assemblies while in their retracted position, the operator moves the outer leg member 36 of each leg assembly 32 into either a fully extended position or a desired intermediate position. Such movement is effected simply by applying a moving force to the associated outer leg member. The associated locking assembly 52 permits the outer leg member to yieldingly move from resilient retention within the fully retracted position into the desired operative position and serves to lockingly retain the leg member from movement out of such position toward the fully retracted position in response to the application of a moving force thereto until the locking assembly is manually moved through a releasing or unlocking operation. In this way the bipod mechanism is capable of simple and convenient movement into the desired firing position and is automatically lockingly retained therein. Movement of the leg assemblies back into the fully retracted and transport position requires manual engagement of the associated locking assemblies 52 and 92 in combination with the application of the moving forces to the outer leg member and leg assemblies respectively.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

I claim:

1. A bipod mechanism for a small arms weapon comprising a pair of individually telescopically adjustable leg assemblies and means connectable in supporting relation with the weapon mounting said pair of leg assemblies in a weapon supporting and firing position wherein said leg assemblies extend downwardly in outwardly converging relation with respect to the longitudinal extent of said weapon, the improvement which comprises:

each of said leg assemblies including an inner leg member of generally L-shaped cross-sectional configuration and an outer leg member of generally L-shaped cross-sectional configuration mounted in generally nested relation with said inner leg member;

pin and slot means between said inner and outer leg members mounting the same for relative longitudinally sliding movement with respect to one another while in said nested relation, said pin and slot means including a longitudinally extending slot in each of said leg members and a headed pin extending through the slot in each leg member and secured to the other leg member; and means for releasably securing said leg members in a plurality of different positions of relative longitudinal movement with respect to one another including a retracted position wherein said leg members are generally longitudinally coextensive.

2. A bipod mechanism as defined in claim 1 wherein said releasable means associated with each leg assembly includes an opening in one of said leg members aligned with the slot in the other leg member, said opening having a transverse dimension greater than the transverse dimension of said aligned slot, a releasable locking member including an enlarged locking portion mounted in said opening within said one leg member for movement toward and away from said other leg member, a central portion extending through said aligned slot, and a releasing portion manually engageable to move said locking portion in a direction away from said other leg member, locking recesses in the surface of said other leg member facing toward said one leg member on opposite sides of said aligned slot for receiving the enlarged locking portion of said locking member when the latter is moved in a direction toward said other leg member into a locking position and spring means for resiliently biasing said locking member to move in a direction wherein the locking portion thereof is in said locking position.

3. A bipod mechanism as defined in claim 2 wherein said spring means includes a coil spring surrounding the central portion of said locking member and acting between said one leg member and the releasing portion of said locking member.

4. A bipod mechanism as defined in claim 2 wherein said recesses include longitudinally spaced locking surfaces preventing relative movement of said leg members into said position and longitudinally spaced cam surfaces operable to move said locking member away from said locking position in response to the relative movement of said leg members in a direction away from said transport position.

5. A bipod mechanism as defined in claim 1, 2, 3 or 4 wherein each leg member includes a multiplicity of longitudinally spaced holes extending therethrough in positions to lighten the weight thereof without adversely effecting the strength thereof.

6. A bipod mechanism for a light weight machine gun comprising a pair of individually telescopically adjustable leg assemblies and means connectable in supporting relation with the gun mounting said pair of leg assemblies for movement between a folded transport position wherein the leg assemblies extend generally parallel alongside the longitudinal extent of the gun and a gun supporting and firing position wherein said leg assemblies extend downwardly in outwardly converging relation with respect to the longitudinal extent of said gun, the improvement which comprises:

each of said leg assemblies including an inner leg member of generally L-shaped cross-sectional configuration and an outer leg member of generally L-shaped cross-sectional configuration mounted in generally nested relation with said inner leg member;

pin and slot means between said inner and outer leg members mounting the same for relative longitudinally sliding movement with respect to one another while in said nested relation, said pin and slot means including a longitudinally extending slot in each of said leg members and a headed pin extending through the slot in each leg member and fixedly secured to the other leg member; and means for releasably securing said leg members in a plurality of different positions of relative longitudinal movement with respect to one another including a transport position wherein said leg members are generally longitudinally coextensive.

7. A bipod mechanism as defined in claim 6 wherein said releasable means associated with each leg assembly includes an opening in one of said leg members aligned with the slot in the other leg member, said opening having a transverse dimension greater than the transverse dimension of said aligned slot, a releasable locking member including an enlarged locking portion mounted in said opening within said one leg member for movement toward and away from said other leg member, a central portion extending through said aligned slot, and a releasing portion manually engageable to move said locking portion in a direction away from said other leg member, locking recesses in the surface of said other leg member facing toward said one leg member on opposite sides of said aligned slot for receiving the enlarged locking portion of said locking member when the latter is moved in a direction toward said other leg member into a locking position and spring means for resiliently biasing said locking member to move in a direction wherein the locking portion thereof is in said locking position.

8. A bipod mechanism as defined in claim 7 wherein said spring means includes a coil spring surrounding the central portion of said locking member and acting between said one leg member and the releasing portion of said locking member.

9. A bipod mechanism as defined in claim 7 wherein said recesses include longitudinally spaced locking surfaces preventing relative movement of said leg members into said position and longitudinally spaced cam surfaces operable to move said locking member away from said locking position in response to the relative movement of said leg members in a direction away from said transport position.

10. A bipod mechanism as defined in claim 6, 7, 8 or 9 wherein said mounting means for each leg assembly includes means for resiliently retaining said leg assembly in said transport position while permitting yielding movement therefrom in a direction toward said firing position in response to the application of a moving force to said leg assembly and for lockingly retaining said leg assembly in said firing position in response to the movement therein while preventing movement therefrom in a direction toward said transport position in response to the application of a moving force to said leg assembly without first unlocking the aforesaid locking retention.

11. A bipod mechanism as described in claim 10 wherein said mounting means comprises:

a mounting structure rigidly attachable to said gun, said mounting structure including a pair of side plates extending generally parallel to the longitudinal extent of said pair of leg assemblies when in said firing position, each of said side plate having a pivotal connection with the associated leg assembly about a transversely extending axis, the pivotal axes of both of said pivotal connections intersecting at a point contained within the vertical plane of symmetry of the gun when in said firing position, and the angle defined between the intersection of said pivotal axes is approximately 120°;

and wherein the resiliently and lockingly retaining means associated with each leg assembly comprises:

a slot formed in the associated side plate arcuate about the associated pivotal axis extending transverse therethrough, said arcuate slot having a generally frusto-conical recess at one end thereof and an enlarged opening at the other end thereof;

a releasable locking member including an enlarged locking portion of a size to engage within said slot opening within said plate;

a central portion transversely slidably mounted within the associated leg member and extending through said arcuate slot;

a releasing portion manually engageable to move said locking portion in a direction away from said slot opening and slot recess; and spring means for resiliently biasing said locking member to move in a direction wherein the locking portion thereof engages said seat recess and said slot opening when aligned respectively therewith.

* * * * *